US012213515B2

(12) United States Patent
Gonzalez

(10) Patent No.: US 12,213,515 B2
(45) Date of Patent: Feb. 4, 2025

(54) METHOD AND APPARATUS FOR COOLING SMOKE

(71) Applicant: Richard Lee Gonzalez, Clifton, NJ (US)

(72) Inventor: Richard Lee Gonzalez, Clifton, NJ (US)

(73) Assignee: 2Chill Imports, Inc., Boulder, CO (US)

( * ) Notice: Subject to any disclaimer, the term of this patent is extended or adjusted under 35 U.S.C. 154(b) by 740 days.

(21) Appl. No.: 16/114,165

(22) Filed: Aug. 27, 2018

(65) Prior Publication Data

US 2018/0360107 A1 Dec. 20, 2018

(51) Int. Cl.
*A24F 1/30* (2006.01)
*A24F 1/02* (2006.01)

(52) U.S. Cl.
CPC . *A24F 1/30* (2013.01); *A24F 1/02* (2013.01)

(58) Field of Classification Search
None
See application file for complete search history.

(56) References Cited

U.S. PATENT DOCUMENTS 4,201,230 A * 5/1980 Howell, Jr. ..... A24F 1/30 131/173
4,215,707 A * 8/1980 Elrich ..... A24F 1/30 131/173
2011/0241513 A1* 10/2011 Nomura ..... F16L 59/065 312/405
2023/0322470 A1* 10/2023 Gonzalez ..... B65D 81/3841 220/592.2

* cited by examiner

*Primary Examiner* — Phu H Nguyen

(57) ABSTRACT

A method and apparatus for cooling smoke wherein a cooling liquid is introduced into a chamber. The chamber includes a containment wall and the method provides for reducing the thermal migration of heat across the containment wall from an outside environment into the chamber. Smoke is received through a stem that protrudes into the cooling liquid. By reducing the pressure applied to the surface of the cooling liquid, through a pressure reduction path, the smoke is drawn downward through the stem into the cooling liquid, where is allowed to bubble up to the surface and enjoyed as cold smoke by a tobacco user.

9 Claims, 7 Drawing Sheets

METHOD AND APPARATUS FOR COOLING SMOKE

BACKGROUND

People have been using tobacco for centuries. When tobacco was first introduced to Europe, it was thought to be a miracle substance. In fact tobacco is prescribed as medication for a wide variety of ailments, including severe cough. Modernly, medical science has demonstrated that the use of tobacco, rather than being a miracle substance, is a root cause of a wide variety of maladies.

Despite the now proven health hazards associated with tobacco use, many people continue to use tobacco. A common means of using tobacco is to inhale smoke created by burning of dry tobacco leaves. Many tobacco users recognize that inhaling the smoke is somewhat uncomfortable because the smoke is at a very elevated temperature, relative to the human body.

In order to reduce the temperature of tobacco smoke, many people now use a "bong". A bong, also known as a water pipe, appears to have been first introduced by Erickson and described in the U.S. Pat. No. 4,216,785. Erickson described a structure that included a long mouthpiece. Penetrating the mouthpiece, according to Erikson, is a smoking stem. At the far tip of the smoking stem, tobacco was burned.

According to Erikson, the temperature of the smoke could be reduced by filling the elongated mouthpiece with a cooling liquid. To enhance the cooling process, frozen matter, for example ice, was also introduced into the cooling liquid. When a user would inhale at a top end of the mouthpiece, the pressure applied to the surface of the cooling liquid would be reduced. Thus, smoke from the smoking stem would be drawn into that portion of the mouthpiece that was filled with cooling liquid. The smoke would then be allowed to bubble up through the cooling liquid and then reached the user at a lower temperature.

Not long after Erickson introduced the concept of a water pipe, the design was further enhanced by increasing the volume at a bottom end of the mouthpiece. Many such designs resemble a flask, typically used in chemistry experiments, wherein the flask would have any elongated neck that would serve as the upper end of the mouthpiece. The increased volume at the bottom end of the mouthpiece would allow the use of a larger volume of cooling liquid. By increasing the volume of the cooling liquid, a tobacco user could enjoy cold smoke for a much longer duration of time. In the water pipe described by Erickson, the volume of cooling liquid was limited by the diameter of the mouthpiece. The amount of cooling liquid that could be introduced into Erickson's water pipe was there by limited, and resulted in the need to frequently replace the cooling liquid.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

Figure 1:
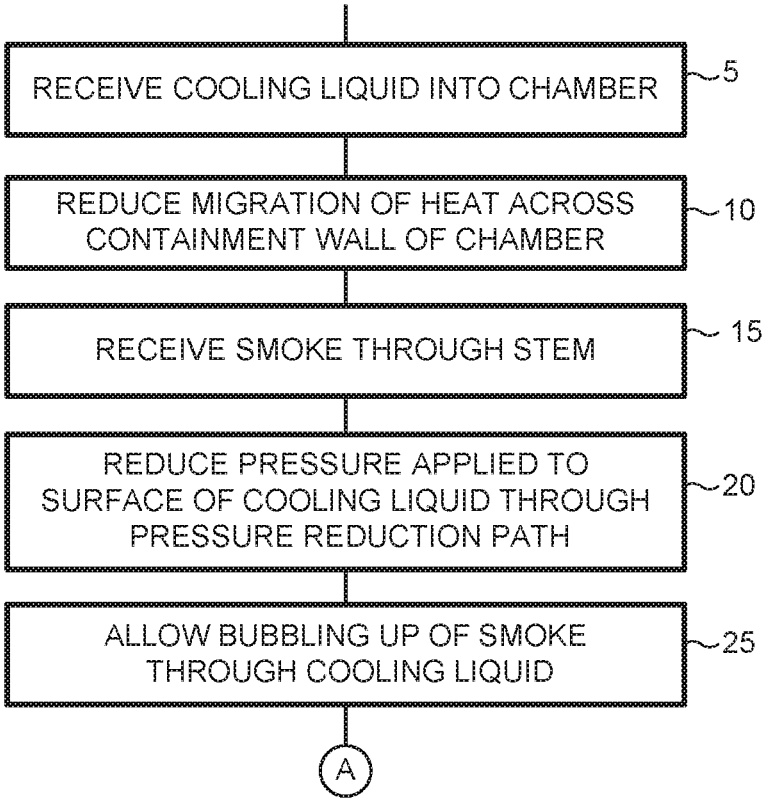
FIG. 1 is a flow diagram that depicts one example method for cooling smoke.

FIG. 1 is a flow diagram that depicts one example method for cooling smoke. In the interest of clarity, several example alternative methods are described in plain language. Such plain language descriptions of the various steps included in a particular method allow for easier comprehension and a more fluid description of a claimed method and its application. Accordingly, specific method steps are identified by the term "step" followed by a numeric reference to a flow diagram presented in the figures, e.g. (step 5). All such method "steps" are intended to be included in an open-ended enumeration of steps included in a particular claimed method. For example, the phrase "according to this example method, the item is processed using A" is to be given the meaning of "the present method includes step A, which is used to process the item". All variations of such natural language descriptions of method steps are to be afforded this same open-ended enumeration of a step included in a particular claimed method.

Unless specifically taught to the contrary, method steps are interchangeable and specific sequences may be varied according to various alternatives contemplated. Accordingly, the claims are to be construed within such structure. Further, unless specifically taught to the contrary, method steps that include the phrase " . . . , comprises at least one or more of A, B, and/or C . . . " means that the method step is to include every combination and permutation of the enumerated elements such as "only A", "only B", "only C", "A and B, but not C", "B and C, but not A", "A and C, but not B", and "A and B and C". This same claim structure is also intended to be open-ended and any such combination of the enumerated elements together with a non-enumerated element, e.g. "A and D, but not B and not C", is to fall within the scope of the claim. Given the open-ended intent of this claim language, the addition of a second element, including an additional of an enumerated element such as "2 of A", is to be included in the scope of such claim. This same intended claim structure is also applicable to apparatus and system claims.

FIG. 1 further illustrates that this example method includes a step wherein a cooling liquid is received into a chamber, further this chamber includes a containment wall (step 5). This example method further comprises a step wherein the movement of heat across the containment wall is reduced (step 10). It should be appreciated that this example method provides for liquid to cool smoke before it is inhaled by a user. As such, the liquid can only cool the smoke for as long as the liquid itself remains cool. Further, the more heat that migrates across the containment wall the hotter the liquid will get. Therefore it is important to prevent as much heat as possible from migrating across the containment wall into the liquid from an outside environment. According to one illustrative use case, the present method is implemented by a smoking apparatus that substantially reduces the amount of heat that migrates across the containment wall into the liquid from an outside environment.

The present example method also includes a step wherein smoke is received through a stem, also one end of the stem is submerged in the cooling liquid (step 15). This example method further comprises a step wherein the user reduces the pressure applied to a surface of the cooling liquid through a pressure reduction path (step 20). This example method also includes a step wherein the smoke is allowed to bubble up through the cooling liquid into the upper portion of the chamber when the pressure applied to the surface of the cooling liquid is reduced (step 25). It should be appreciated, that as the user reduces the pressure applied to the surface of the cooling liquid smoke from the stem moves through the cooling liquid into the upper portion of the chamber. It should further be appreciated that the smoke is substantially cooled as it moves through the cooling liquid. According to various illustrative use cases, once the smoke is cooled and been allowed to move into the upper portion of the chamber the user can inhale the substantially cooled smoke by way of the pressure reduction path at the user's leisure.

Figure 2:
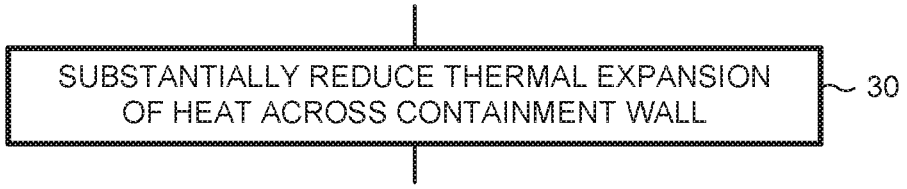
FIG. 2 is a flow diagram that depicts one alternative example method for using insulation to reduce the migration of heat across the containment wall.

FIG. 2 is a flow diagram that depicts one alternative example method for using insulation to reduce the migration of heat across the containment wall. This alternative example method comprises a step wherein the coefficient of thermal transfer in a region proximate to the outer surface of the containment wall of the chamber is substantially reduced (step 30). It should be appreciated, that one method for reducing thermal migration of heat across the containment wall is to provide proximate to the containment wall another material that is substantially inefficient at thermal transfer. It should further be appreciated that this thermal transfer inefficiency will help substantially prevent heat for moving across the material and reaching the containment wall and heating up the cooling liquid.

Figure 3:
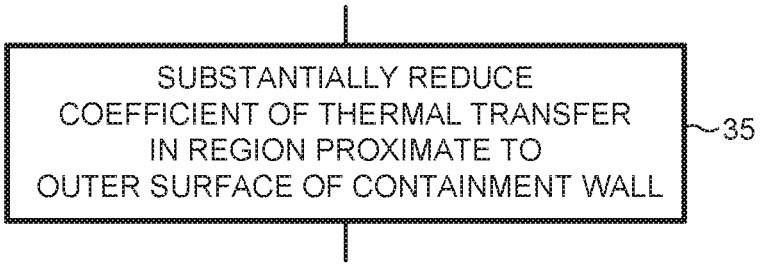
FIG. 3 is a flow diagram that depicts one alternative example method for reducing matter proximate to the outside of the containment wall to reduce migration of heat across the containment wall.

FIG. 3 is a flow diagram that depicts one alternative example method for reducing matter proximate to the outside of the containment wall to reduce migration of heat across the containment wall. The present alternative example method includes a step wherein the concentration of matter at an outer surface of the containment wall of the chamber is substantially reduced (step 35). It should be appreciated that thermal migration happens when heat is transferred through matter. Further, heat migration is substantially reduced when there is less matter for the heat to move through. As such, when the amount of matter proximate to the containment wall of the chamber is substantially reduced, heat migration is substantially halted because there is little matter for the heat to move through. It should further be appreciated, that less thermal transfer means the cooling liquid stays cool substantially longer and the user can enjoy the use of the smoking apparatus for a longer period of time.

Figure 4:
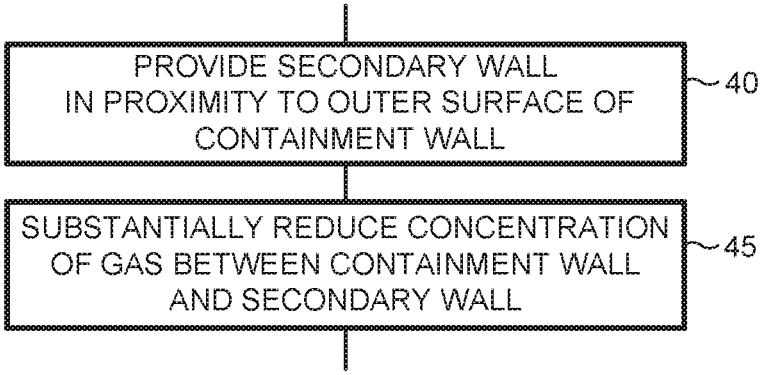
FIG. 4 is a flow diagram that depicts one alternative example method that uses a vacuum barrier to reduce migration of heat across the containment wall.

FIG. 4 is a flow diagram that depicts one alternative example method that uses a vacuum barrier to reduce migration of heat across the containment wall. According to this alternative example method, reduction of thermal migration is accomplished by and thereby comprises providing a secondary wall in proximity to an outer surface of the containment wall (step 40). This alternative example method also includes a step for substantially reducing the concentration of gaseous matter between the containment wall of the chamber and said secondary wall (step 45). It should be appreciated that, when the concentration of gaseous matter between the chamber's containment wall and the secondary wall is substantially reduced, the amount of heat that reaches the containment wall is substantially reduced.

Figure 5:
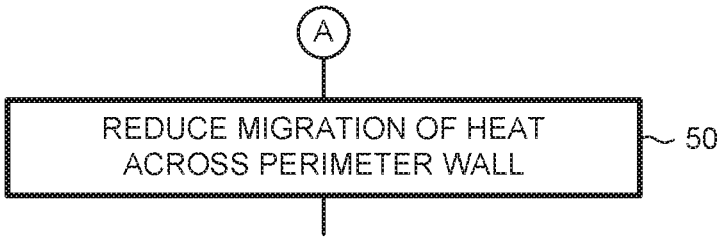
FIG. 5 is a flow diagram that depicts one alternative example method wherein heat migration across the perimeter wall of the pressure reduction path is substantially reduced.

FIG. 5 is a flow diagram that depicts one alternative example method wherein heat migration across the perimeter wall of the pressure reduction path is substantially reduced. The present alternative example method includes a step wherein the migration of heat across the perimeter wall of the pressure reduction path is substantially reduced (step 50). As explained above, the smoke is substantially cooled as it moves through the cooling liquid. Further, once the smoke has moved through the cooling liquid and been allowed to bubble up into the upper portion of the chamber it will substantially remain there until enjoyed by the user. As such, it is helpful to prevent migration of heat into the pressure reduction path and down into the smoke until the user has had the opportunity to inhale the smoke.

Figure 6:
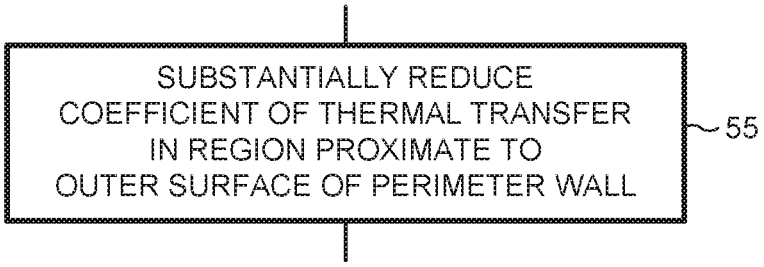
FIG. 6 is a flow diagram that depicts one alternative example method for using insulation to substantially reduce heat migration across the perimeter wall of the pressure reduction path.

FIG. 6 is a flow diagram that depicts one alternative example method for using insulation to substantially reduce heat migration across the perimeter wall of the pressure reduction path. According to this alternative example method reduction of heat migration is accomplished by, and thereby comprises substantially reducing the coefficient of thermal transfer in a region proximate to an outer surface of the perimeter wall of the pressure reduction path (step 55). As explained above, movement of heat is substantially hampered when an insulating material has a low coefficient of thermal transfer. As such, the amount of heat that reaches the perimeter wall will be substantially reduced when an insulating material is placed in the region proximate to the outer surface of the perimeter wall. According to various illustrative implementations the insulating material is wrapped around the pressure reduction path. According to other various illustrative use cases the insulating material is substantially attached to the pressure reduction path to prevent the insulating material from being easily dislodged.

Figure 7:
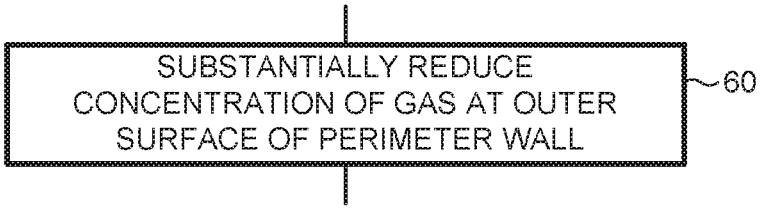
FIG. 7 is a flow diagram that depicts one alternative example method for reducing matter proximate to the outside of the perimeter wall to reduce migration of heat across the perimeter wall.

FIG. 7 is a flow diagram that depicts one alternative example method for reducing matter proximate to the outside of the perimeter wall to reduce migration of heat across the perimeter wall. The present alternative example method includes a step wherein the concentration of matter in the region proximate to the outer surface of the perimeter wall of the pressure reduction path is substantially reduced (step 60). As illustrated above, heat moves through matter and has a more difficult time moving across a space when the space is substantially devoid of matter. Further, because less heat reaches the perimeter wall, less heat will enter the pressure reduction path. This means the smoke will remain cool for a greater duration of time. According to various illustrative use cases the user chooses a smoking apparatus the implements these methods to enjoy liquid cooled smoke. As such the longer the smoke remains cool, the longer the user has to enjoy the smoke at their leisure.

Figure 8:
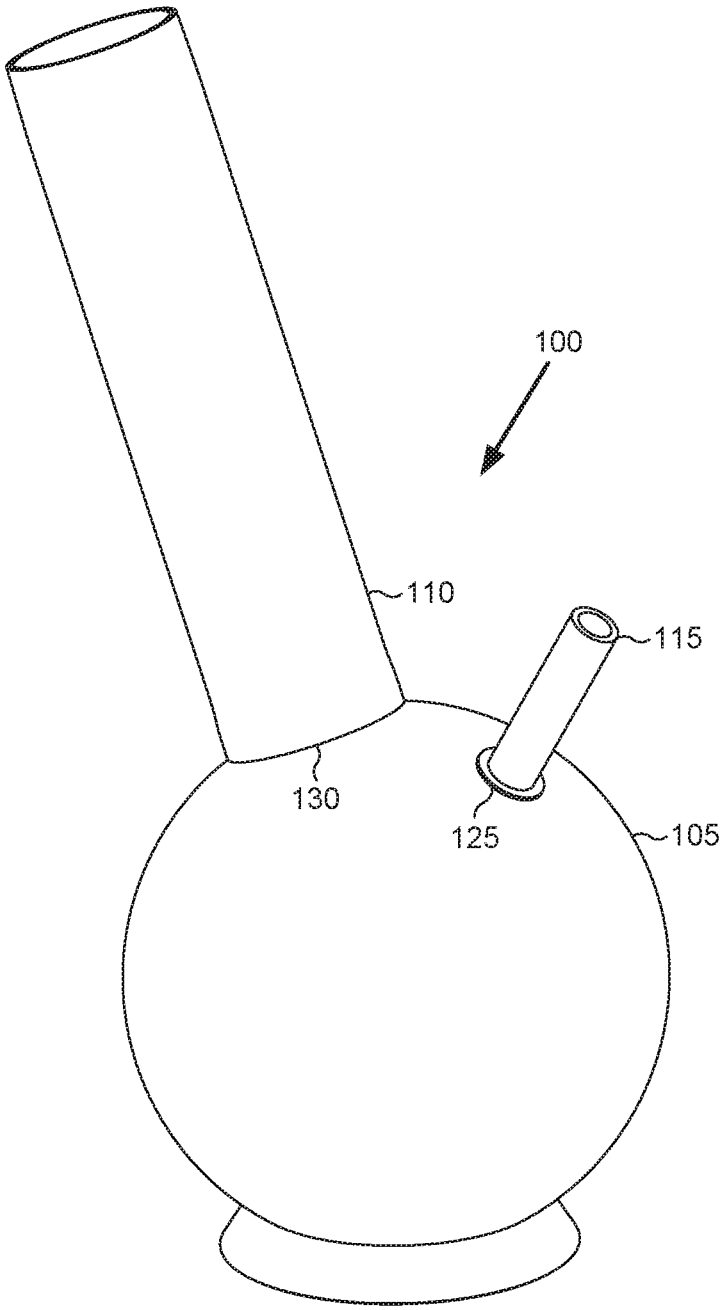
FIG. 8 is a pictorial diagram that illustrates one example embodiment of a smoking apparatus.

FIG. 8 is a pictorial diagram that illustrates one example embodiment of a smoking apparatus. It should be appreciated that, according to one example embodiment, a smoking apparatus 100 comprises a cooling chamber 105. The cooling chamber is provided in order to receive a cooling liquid. According to one alternative example embodiment, the smoking apparatus 100 further comprises a mouthpiece 110, which is attached to a smoke outlet 130 included in the cooling chamber 105. The cooling chamber 105 also includes an orifice 125, which is used to accept a smoking-stem 115. It should be appreciated that, according to this example embodiment, the orifice 125 is disposed above an intended liquid-level-line.

Figure 9:
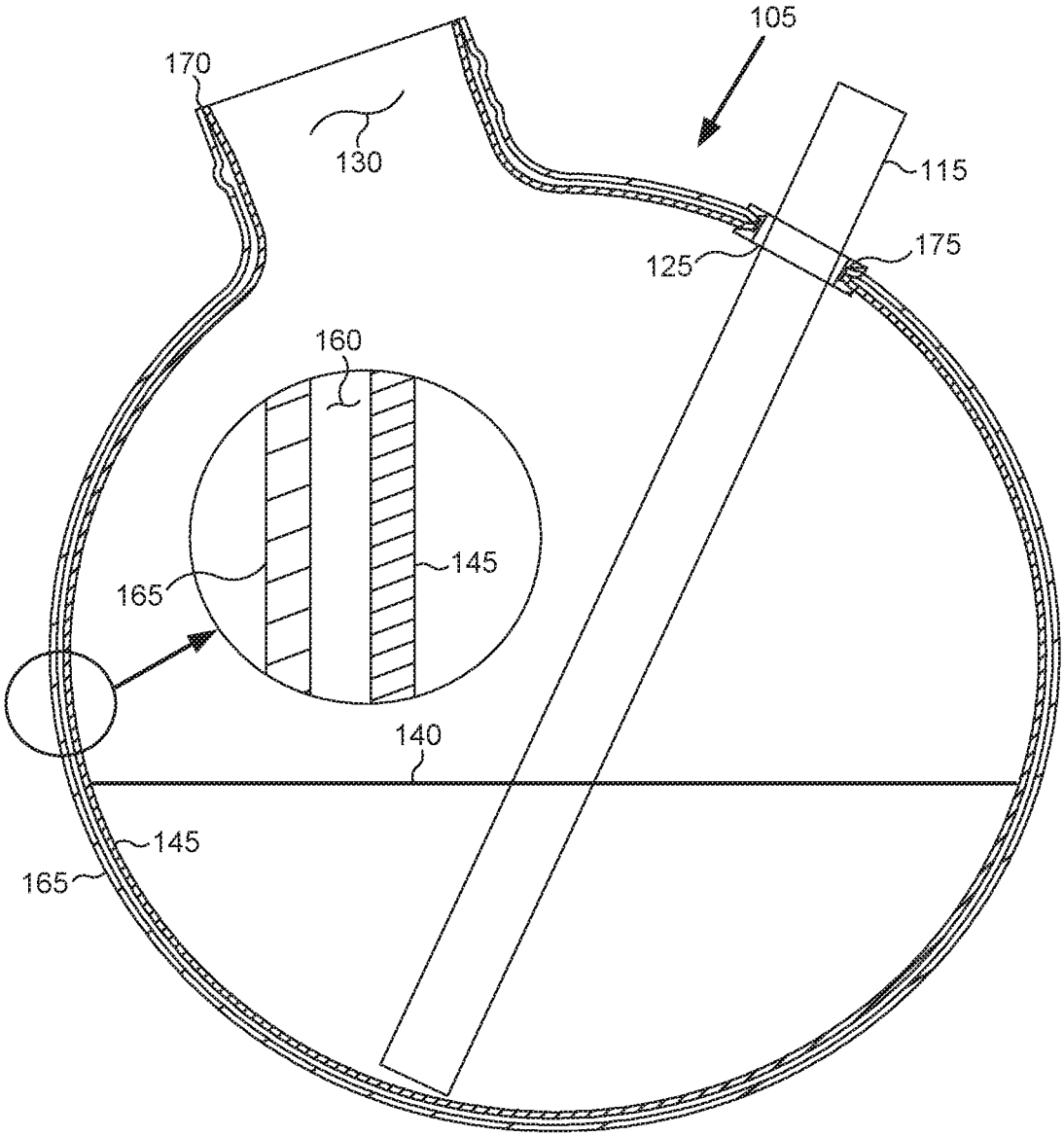
FIG. 9 is a pictorial diagram that illustrates a cross-section of a cooling chamber.

FIG. 9 is a pictorial diagram that illustrates a cross-section of a cooling chamber. During use, the smoke-outlet 130 is offset from the vertical to allow ease of inhalation of smoke by a user. Also during use, a smoking-stem 115 is disposed through the orifice 125 and is allowed to protrude into the cooling chamber 105. Also, this multi-stem 115 is allowed to touch the bottom of the cooling chamber so that inserted and falls below a liquid-level-line 140. During use, liquid is introduced into the cooling chamber 105, which is usually provided in an amount up to a liquid-level-line 140. It should be appreciated that the liquid-level-line 140 varies according to user preference and that there is no physical liquid-level-line 140 included in the cooling chamber 105.

The cooling chamber 105 includes an internal wall 145. Immediately proximate to the outside of the internal wall 145 there is a thermally insulative barrier 160, which is included in this example embodiment. It should be noted that, according to this example embodiment, the orifice 125 penetrates through the internal wall 145 and through the thermally insulative barrier 160. It should be noted that the thermally insulative barrier 160 substantially envelopes the outside of the inner wall. It should likewise be appreciated that the thermally insulative barrier 160 reduces the amount of heat that reaches the inner wall 145 from an outside environment.

It should likewise be appreciated that both the smoke-outlet 130 and the orifice 125 are disposed above an intended liquid-level-line 140. According to one alternative example embodiment, both of the smoke-outlet 130 and the orifice 125 are disposed in an upper one third of the cooling chamber 105. However, wide variations of placement of the smoke-outlet 130 and the orifice 125 are contemplated and any particular placement of these features and where these features penetrate the inner wall 145 and the thermally insulative barrier 160 included in the cooling chamber 150 are not intended to limit the scope of the claims appended hereto.

FIG. 9 also illustrates that, according to one alternative example embodiment, the thermally insulative barrier 160 comprises an outer wall 165 which is hermetically conjoined with the inner wall 145 at the perimeter 175 of the orifice 125 and at perimeter 170 of the smoke-outlet 160. It should be appreciated that the volume, according to this alternative example embodiment, formed between the inner 145 and the outer 165 walls is at a substantially lower air pressure than one atmosphere. It should likewise be appreciated that, this alternative example embodiment is formed using vacuum bottle techniques that are commonly practiced. Accordingly, one alternative example embodiment of the cooling chamber 105 comprises a first metal shell, which forms the inner wall 145, and a second metal shell that forms the outer wall 165. During manufacturing, the first and second metal shells hermetically conjoined at the affirmation orifice perimeter 175 and the smoke-outlet perimeter 170.

Conjoining the first metal shell and the second metal shell, according to one alternative example method of manufacturing the smoking apparatus, is accomplished by welding the first and second shells together around these perimeters in a very low pressure environment. Then, the smoking apparatus is used in a normal environment. Because the volume between the first and second shells is at a much lower air pressure, a thermally insulative barrier 160 is formed according to traditional vacuum bottle techniques. It should likewise be appreciated that, commensurate with vacuum bottle manufacturing technology, the gaseous pressure in the volume created between the inner wall 145 and the outer wall 165 is at no greater than 0.01 Torr, and in one alternative embodiment no greater than 0.0001 Torr. According to yet another alternative example embodiment, the distance between the inner and outer walls is no less than 2 mm.

According to yet another alternative example embodiment, the thermally insulative barrier comprises the outer wall 145 and an insulative material 160 comprising at least one or more of a gaseously expanded urethane foam and/or a polystyrene foam. According to these alternative example embodiments, the insulative material 160 is adhered to the outer surface of the inner wall 145. Thus, an insulative effect is provided wherein the amount of heat reaching the inner wall of the cooling chamber 105 is reduced.

According to yet another alternative example embodiment, a protective coating 165 is then applied to the outer surface of the insulative material 160. It should be appreciated that application of the insulative material 160 to the outer surface of the inner wall 145 is accomplished by known techniques, which shall not be elaborated upon here. Likewise, application of the protective coating 165 is also accomplished by known techniques, which also shall not be discussed here. In yet another alternative embodiment, the insulative material is selected so as the heat-transfer-index of the material is less than 0.05 $W \cdot m^{-1} \cdot K^{-1}$. According to one alternative example embodiment, the thickness of the internal insulative layer is no less than 2 mm.

Figure 10:
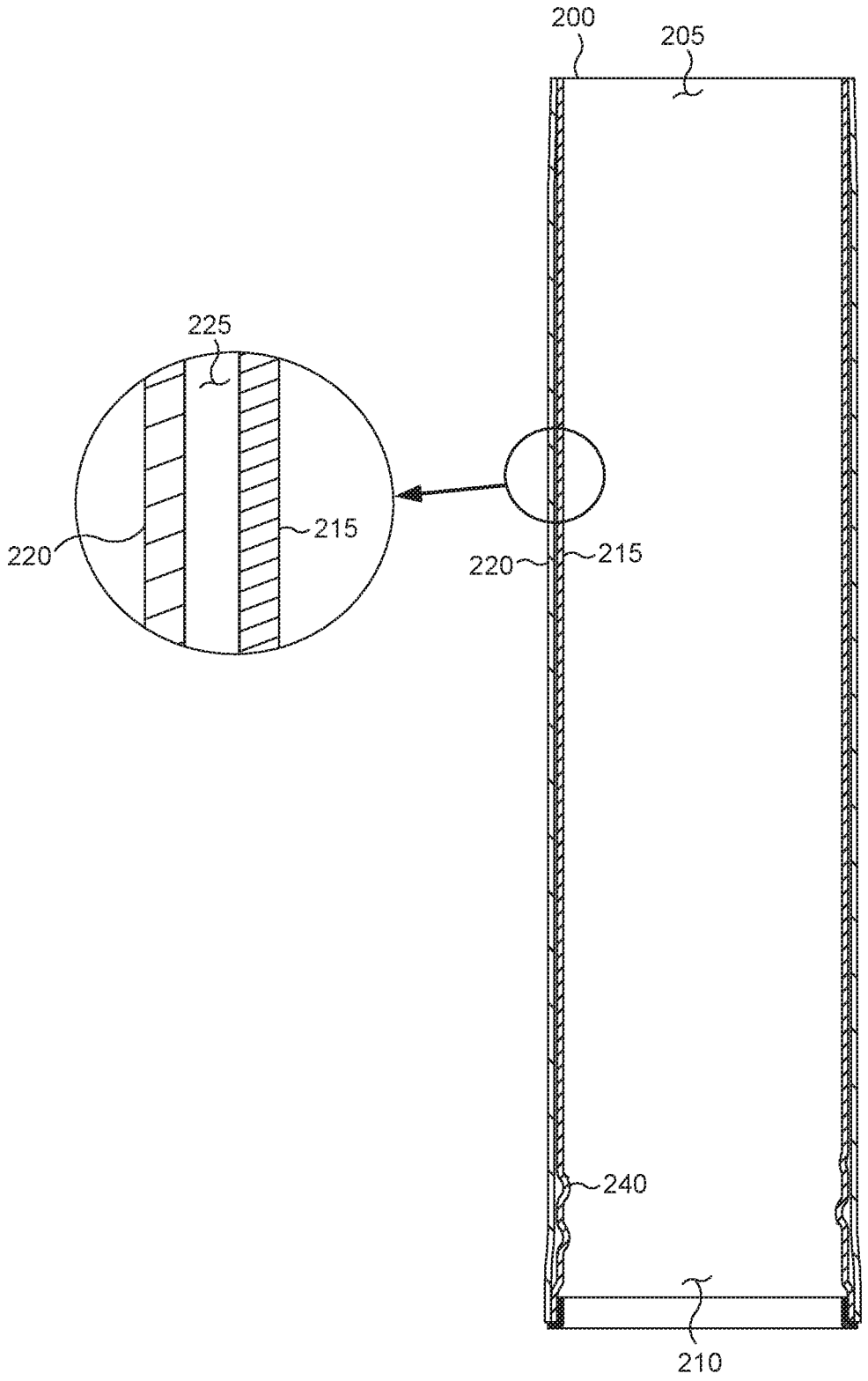
FIG. 10 is a pictorial diagram that illustrates one example embodiment of a multi-piece.

FIG. 10 is a pictorial diagram that illustrates one example embodiment of a multi-piece. According to this example embodiment, a mouth-piece 200, which is attached to the smoke-outlet included in the cooling chamber 105, itself comprises a first end 205 and a second end 210. According to this example embodiment, the mouth-piece 200 is substantially tubular. As such, this example embodiment of a mouth-piece 200 includes an inner wall 215 and a thermally insulative barrier 225 disposed substantially around the outer surface of the inner wall 215 of the mouthpiece 200.

According to one alternative example embodiment, the thermally insulative barrier disposed substantially around the inner wall of the mouthpiece comprises an outer wall 220 that is hermetically conjoined with the inner wall 215. It should be appreciated that, according to this alternative example embodiment of a mouthpiece, the inner wall 215 and the outer wall 220 are conjoined at a perimeter of the first end 205 and at the perimeter of a second end 210. As heretofore described, techniques for manufacturing metal-walled vacuum bottles are utilized in order to form an insulative barrier wherein the volume formed between the inner and outer walls is at a substantially lower air pressure than one atmosphere. According to yet another alternative example embodiment, the gaseous pressure within the volume created between the inner wall 215 and the outer wall 220 is no greater than 0.01 Torr, and in one alternative embodiment no greater than 0.0001 Torr. According to yet another alternative example embodiment, the distance between the inner and outer walls is no less than 2 mm.

Analogous to one alternative example embodiment of the cooling chamber 105, one alternative example embodiment of the mouth-piece is insulated using an insulative material 225 which is applied to the outer surface of the inner wall 215. In this alternative example embodiment, the insulative material comprises at least one or more of a gaseous sleeve expanded urethane foam and/or a polystyrene form. In yet another alternative embodiment, the insulative material is selected so as the heat-transfer-index of the material is less than 0.05 $W \cdot m^{-} \cdot K^{-1}$. According to one alternative example embodiment, the thickness of the internal insulative layer is no less than 2 mm.

FIG. 10 also illustrates that, according to one alternative example embodiment, the mouth-piece comprises an internal thread 240 at a second end 210. This internal thread 240 corresponds to an outer thread included proximate to the smoke-outlet included in the cooling chamber 105.

Figure 11:
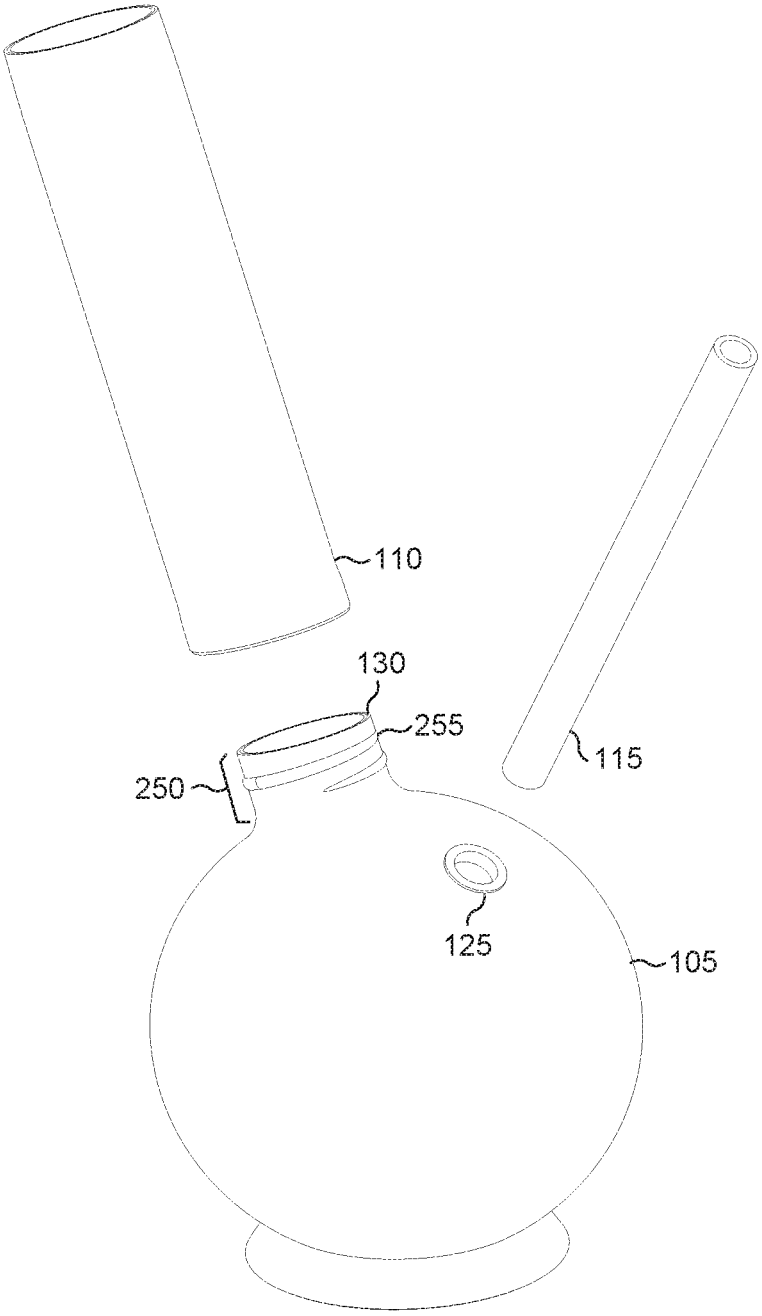
FIG. 11 is a pictorial diagram that illustrates one alternative example embodiment of a smoking apparatus that includes a detachable mouth-piece.

FIG. 11 is a pictorial diagram that illustrates one alternative example embodiment of a smoking apparatus that includes a detachable mouth-piece. According to this alternative example embodiment, the smoke-outlet 130 comprises a short stem 250. Also in this alternative and example embodiment, the outer surface of the short stem 250 includes an external thread 255. This alternative example embodiment of a smoking apparatus includes such attachment interface that includes the short stem 250, the external thread 255 included thereon, and a detachable mouth-piece 110. The mouth-peace 110 of this alternative embodiment also includes an inner wall and a thermally insulative barrier disposed around said inner wall as heretofore described.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the claims appended hereto include all such alternatives, modifications, permutations, and equivalents. Even though many of the embodiments herein described are described relative to the use of tobacco, this illustrative use case is not intended to limit the scope of the claims appended hereto.

What is claimed is:

1. A smoking apparatus comprising:

a cooling chamber having a generally semi-spherical shaped upper portion, the cooling chamber capable of receiving a cooling liquid, said cooling chamber including:

a curved inner wall;

a thermally insulative barrier disposed substantially around the inner wall;

an orifice that penetrates through the thermally insulative barrier and through the inner wall, said orifice sized to accept a smoking-stem and placed above a liquid-level-line;

a smoke-outlet that penetrates through the thermally insulative barrier and through the inner wall, said smoke-outlet being positioned at an upper region of the generally semi-spherical shaped upper portion of the cooling chamber and directly generally upward, the smoke-outlet being placed at a point above the liquid-level-line; an outer wall disposed substantially around the thermally insulative barrier; and the smoke-outlet and the orifice being positioned in the generally semi-spherical shaped upper portion of the cooling chamber.

2. The smoking apparatus of claim 1 wherein the outer wall is hermetically conjoined with the inner wall at a perimeter of the orifice and at a perimeter of the smoke-outlet and wherein a volume formed between the inner and outer walls is at a substantially lower air pressure than one atmosphere.

3. The smoking apparatus of claim 1 wherein the outer wall is hermetically conjoined with the inner wall at a perimeter of the orifice and a perimeter of the smoke-outlet and wherein a volume formed between the inner and outer walls is at a gaseous pressure of no more than 0.01 Torr.

4. The smoking apparatus of claim 1 wherein the thermally insulative barrier comprises:

an insulative material having a heat-transfer-index of less than 0.05 $W \cdot m^{-1} \cdot K^{-1}$.

5. The smoking apparatus of claim 1 further comprising a mouth-piece attached to the smoke-outlet and wherein the mouth-piece includes:

a first end;

a second end;

an inner wall; and a thermally insulative barrier disposed substantially around the inner wall of said mouth-piece.

6. The smoking apparatus of claim 5 wherein the outer wall is hermetically conjoined with the inner wall at the perimeter of the first end and at the perimeter of the second end and wherein a volume formed between the inner and outer walls is at a gaseous pressure of no more than 0.01 Torr.

7. The smoking apparatus of claim 1 wherein the thermally insulative barrier disposed substantially around the inner wall of the mouth-piece comprises:

an insulative material comprising at least one or more of a gaseously expanded urethane foam and/or polystyrene foam.

8. The smoking apparatus of claim 1 wherein the thermally insulative barrier disposed substantially around the inner wall of the mouth-piece comprises:

an insulative material having a heat-transfer-index of less than 0.05 $W \cdot m^{-1} \cdot K^{-1}$.

9. The smoking apparatus of claim 1 wherein the smoke-outlet further includes an attachment interface and further comprising a mouth-piece and wherein the mouth-piece includes:

a first end including an attachment interface that corresponds to the attachment;

an interface included in the smoke-outlet;

a second end;

an inner wall; and a thermally insulative barrier disposed substantially around the inner wall of said mouth-piece.

* * * * *